United States Patent [19]

Wyss

[11] Patent Number: 5,037,209

[45] Date of Patent: Aug. 6, 1991

[54] APPARATUS FOR THE MIXING OF FLUIDS, IN PARTICULAR PASTY MEDIA AND A PROCESS FOR ITS OPERATION

[76] Inventor: Kurt W. Wyss, Brunngasse 87, Reinach, Switzerland, CH-4153

[21] Appl. No.: 306,999

[22] Filed: Feb. 3, 1989

[30] Foreign Application Priority Data

Feb. 8, 1988 [CH] Switzerland ..... 430/88

[51] Int. Cl.[5] ..... B01F 7/28

[52] U.S. Cl. ..... 366/246; 366/343; 366/98; 416/91

[58] Field of Search ..... 416/91, 90 A, 175, 231, 416/232, 235; 366/65, 98, 247, 329, 343

[56] References Cited

U.S. PATENT DOCUMENTS

| | | | |
|---|---|---|---|
| 31,554 | 2/1861 | Mickey | 366/328 |
| 54,891 | 5/1866 | Gelston | 416/91 X |
| 119,193 | 9/1871 | Smith et al. | 366/328 |
| 122,075 | 12/1871 | Still | 416/91 |
| 169,835 | 11/1875 | Payne | 416/91 |
| 407,672 | 7/1887 | Littlefield | 461/91 |
| 1,012,308 | 12/1911 | Wieland | 416/91 |
| 1,846,027 | 10/1930 | Eaton et al. | 366/328 |
| 2,103,243 | 12/1937 | Bradford, Jr. | 416/91 |
| 4,536,092 | 8/1985 | Kedem | 366/328 |

FOREIGN PATENT DOCUMENTS

| | | | |
|---|---|---|---|
| 333494 | 12/1958 | Switzerland . | |
| 615361 | 11/1980 | Switzerland . | |
| 749327 | 5/1956 | United Kingdom | 416/91 |

OTHER PUBLICATIONS

Technische Stromungslehre (Fluid Mechanics) Willi Bohl, Vogel Buchverlag Wurzburg, 7th Edition.

Liquid Mixing and Processing in Stirred Tanks, F. A. Holland and F. S. Chapman, Reinhold Publishing Corp., N.Y., 1966.

Fluid Mixing Technology, James Y. Oldshue, Ph. D., McGraw-Hill Publications Co., N.Y., 1966.

Ruhrtechnik (Stirring Technology), Hanspeter Wilke, Christain Weber, Thomas Fries, Dr. Alfred Huthig, Verlag Heidelberg, 1988.

*Primary Examiner*—Frankie L. Stinson

*Attorney, Agent, or Firm*—Ralph W. Selitto, Jr.

[57] ABSTRACT

A stirring mechanism, with a plurality of hollow, at least partially conically shaped stirring elements, which are provided with two openings, are symmetrically offset and are fixed on the stirring shaft (2) at least approximately tangential to an imaginary circular cylinder coaxial to the stirring shaft.

In the starting phase, the stirred substance flows laminarly through the stirring elements 8. However, as soon as they have reached a predetermined minimum velocity of about 1.3 m/s, the flow inside the stirring elements 8 is forced to reverse by dynamic pressure. The resultant counterflow (11, 12, 13) brings about an outstanding, extensive and nevertheless extremely gentle stirring effect with low power consumption. Also, an effective and uniform gassing can be obtained with simple means, without the stirring velocity having to be increased.

23 Claims, 3 Drawing Sheets

APPARATUS FOR THE MIXING OF FLUIDS, IN PARTICULAR PASTY MEDIA AND A PROCESS FOR ITS OPERATION

The present invention relates to an apparatus for stirring and mixing fluids, in particular, for the gentle mixing or deaeration of viscous fluids.

Such stirring mechanisms, as described for example in Swiss Patent Specification 615,361, require a relatively high motor output to achieve the desired thorough mixing effect, which brings with it on the one hand problems in the sealing of the shaft rotating at high speed; on the other hand, the high circumferential velocities and the shearing effects produced by the sharp-edged stirring elements of the known stirring mechanisms and leads to product damage, which is very disadvantageous for sensitive stirred substances, such as for example in the foodstuffs industry or biochemistry. Similarly, the time requirement for a good thorough mixing is too high with regard to the frictional heat thereby produced.

Conventional stirring mechanisms are described, for example, in the following publications:

Technische Strömungslehre (Fluid Mechanics) Willi Bohl, Vogel Buchverlag Würzburg, 7th edition

*Liquid Mixing and Processing in Stirred Tanks* F. A. Holland and F. S. Chapman, Reinhold Publishing Corporation, New York 1966

*Fluid Mixing Technology* James Y. Oldshue Ph.D., Mc Graw-Hill Publications Co.; New York 1983

Rührtechnik (Stirring Technology) Hans-Peter Wilke Christian Weber Thomas Fries, Dr. Alfred Hüthig Verlag Heidelberg, 1988

*Dubbel* W. Beitz and K.-H. Küttner, Springer Verlag Berlin Heidelberg, 15th edition These known stirring mechanisms are all designed to produce great turbulences by sharp-edged stirring elements or strong blast nozzles, in order to achieve a great swirling of the mixed substance. As a result, an intake of air may also occur, which is undesired in certain cases, for example in paint mixing operations and in the ceramics industry. In the case of sewage treatment plants, on the other hand, a good gassing with oxygen is of major importance., in order that the aerobic decomposition by microbes and bacteria is encouraged as much as possible. In the case of the known mixing mechanisms, the intake of gas or air can only be influenced poorly, due to their high rotational velocity.

In order to transfer a gas or a gas component into a liquid, as large a phase interface as possible is necessary. This takes place either by the gas being distributed over the entire cross section by a corresponding gas distributor or by a stirrer being used to generate sheer stresses, by means of which a local gas flow is distributed over the entire tank content. In the first case, there is no mixing effect and in the second case high rotational speeds are necessary. High rotational speeds are disadvantageous not only because of the enormously high energy consumption, but also because of the unavoidable splashing of the stirred substance, which in the case of sewage treatment plants, for example, is associated with an unpleasant odor for the environment.

Finally, quite special requirements are demanded of a mixing mechanism when thoroughly mixing fibrous material. The fibers namely become caught on the conventional stirring blades and have to be removed at short intervals, depending on the application.

For safety reasons, as a rule stirring apparatuses have to be designed to close seal-tightly, the sealing elements on conventional mixers with shafts rotating at high speeds constituting a particular source of danger.

Finally, it should be stressed once more that the high drive speed necessary for attaining a satisfactory stirring effect requires a large energy consumption and brings about a—in many cases—unnecessary or even undesired heating of the product and an intake of air.

Swiss Patent Specification 333,494 describes a rotary mixer which has a plurality of solid disks which are arranged on a rotatingly drivable shaft, at right angles to the shaft axis, and on whose circumference small open tubes are fixed on both sides. The small tubes fixed on two neighboring disks form different angles with the disk planes, the intention being to produce a zone of intensive thorough mixing and high flow velocity throughout the tank. The small tubes used are conical and point with their larger opening in the direction of rotation.

Such apparatuses, the main object of which is the generation of high turbulence and great flow velocities of the medium, are possibly suitable for the dispersing and homogenizing of products whose particles may without any hesitation, in view of the subsequent use of the product, be subjected to the destructive shearing forces. They are not suitable for the gentle treatment of products sensitive to impact and shearing forces.

The arrangement of the stirring elements on the circumference of solid disks also brings with it the disadvantage that virtually only a radial flow can develop in the region of the stirring elements, which greatly impairs the endeavoured thorough mixing of the entire volume in the tank, or at least leads to much longer stirring times.

In comparison with this, it is the object of the present invention to propose a stirring apparatus which allows even highly sensitive substance pairings, such as for example liquids containing liquid crystals, to be transformed into a state of homogenous mixture in a gentle way in the shortest time with low energy consumption. To do so, as experience has shown, great turbulences and accordingly also high circumferential velocities must be avoided, while at the same time however the avoidance of dead zones is also to be endeavoured.

A further aspect of this object is to be seen in that the stirring apparatus according to the invention is also to be suitable for the degassing or deaerating of liquid and pasty compounds, as are necessary for example in the ceramics industry.

The advantages of the invention are on the one hand the saving in energy and time as well as the product improvement due to extremely gentle treatment of the stirred substance. A small starting torque is used by the stirring mechanism to set itself in motion, with laminar flow, and, at a relatively low velocity of movement of the stirring elements, it achieves an outstanding mixing effect, which is essentially based on specifically directed opposed flows within the stirred substance. Virtually complete thorough mixing already occurs after much shorter times than is the case with known stirring methods. It is only the low speed that enables development of the counterflow mentioned. The drive output of the stirring mechanism can therefore be kept much lower than was the case hitherto.

In the case of the run-through neutralization plants used in sewage purification, the short residence time of the medium to be purified is of decisive importance.

Conventional stirring mechanisms require far too much time for complete neutralization of a clarification basin, so that this neutralization system can only be realised very poorly and with very high energy consumption.

Due to the fact that the stirring substance does not completely pass through the stirring element in normal operation but activates a counterflow in front of the stirring element due to the incompressibility of the liquid, virtually nothing is caught on the stirring element, so that cleaning is only required sporadically. In the case of treatment plants which have a high proportion of fibers, for example waste water from surgical bandage factories, it has been found furthermore that no fibers are caught on the stirring elements, since the flow pushes them away from the stirring element. Due to this fact, it has likewise been found that, in the case of liquids with solid additives, which inevitably contain proportions of air (fibers), the air accumulates during the short mixing operation around and in the stirring element and, whenever there is a short interruption in the mixing operation or a brief deceleration, rises to the surface as a large bubble at each stirring element and thus frees the mixed substance of the air. Due to this fact, in the ceramics industry, the reject rate in the porcelain production has decreased by up to 80%. Due to the gentleness of the mixing operation, no foam occurs in color tinting operations. With the new, environmentally harmless water-based paints (new regulations), a gentle and quick thorough mixing is an essential requirement. This result cannot be achieved with high-speed stirrers.

Thanks to an extremely low development of heat, the stirring mechanism is also ideally suited for sensitive media, with which we are familiar for example from the foodstuffs industry and biochemistry. For example, for the first time highly sensitive yoghurt has been successfully mixed in the shortest time with a stirring mechanism, and not manually as hitherto, without any change in viscosity. Furthermore, hitherto pigments (hammer effect) were stirred manually, which can be carried out with the present process without any problems and in the shortest time.

The excellent mixing effect allows the mixing times to be greatly shortened. For example, in neutralization plants, 18,000 lt of waste water can be brought from pH 11 to pH 6 to pH 5 in 20 seconds with a drive output of 1.5 kW.

The extensive subjection to stirring of the stirred substance ensures that the material is taken up by the flow and involved in the stirring operation even in rectangular tanks and with flat tank bottoms, for example in containers, at the edges and in the corners.

The invention is explained in more detail below by way of example with reference to a drawing, in which.

Figure 1:
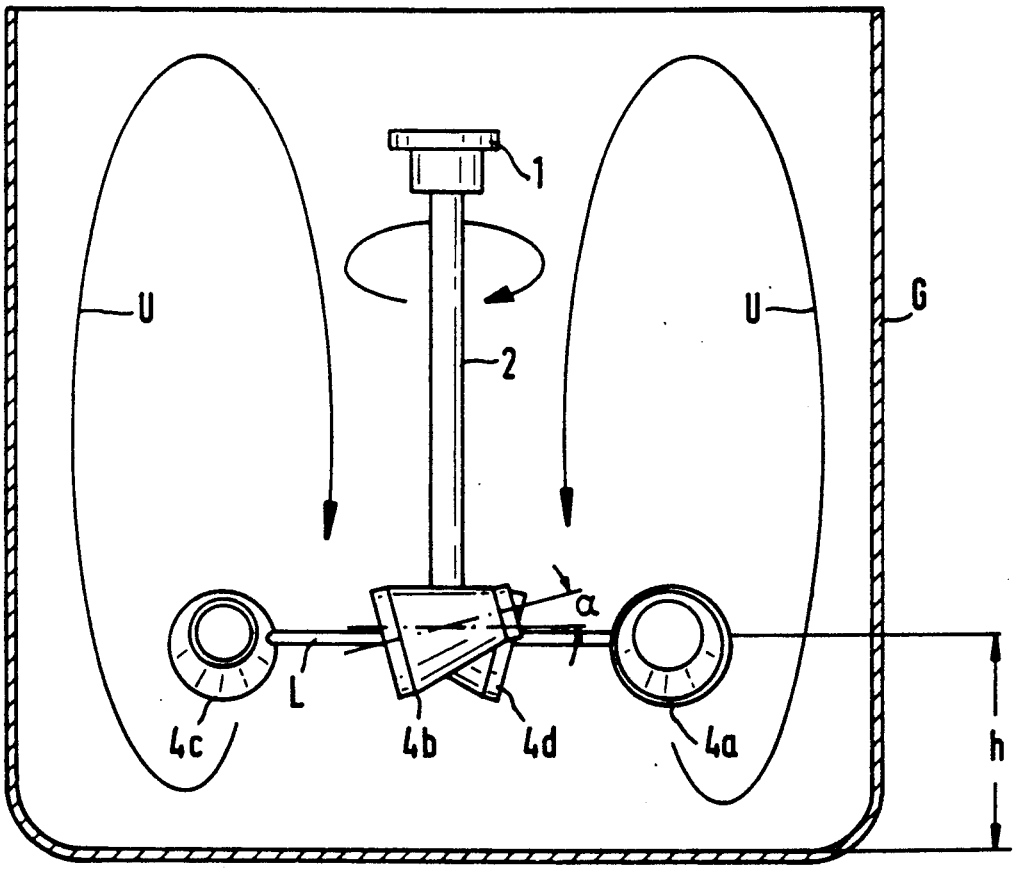
FIG. 1 shows a diagrammatic representation of the apparatus according to the invention, with flow profile.

According to FIG. 1, in a diagrammatically indicated tank G, a shaft 2 is provided at its upper end with a coupling 1, which allows the connection of the shaft 2 to a drive motor (not shown) arranged above the tank G. At the lower end of the shaft 2, four supporting arms L are fixed. The fixing to the shaft 2 may take place, for example, via a middle part, which connects the four supporting arms L to one another and is screwed on the shaft 2 or is connected rotationally rigidly to the shaft 2 in some other known way.

At the free ends of each supporting arm L there are arranged stirring elements 4*a*, 4*b*, 4*c*, 4*d*. Each of these stirring elements is designed as a conical tube section, which has a cross section narrowing oppositely to the direction of rotation, i.e. in the direction of the throughflow.

All stirring elements 4*a*, 4*b*, 4*c*, 4*d* are arranged at the ends of the supporting arms L such that they lie at least approximately tangentially on the surface of an imaginary circular cylinder coaxial to the shaft 2.

Figure 3:
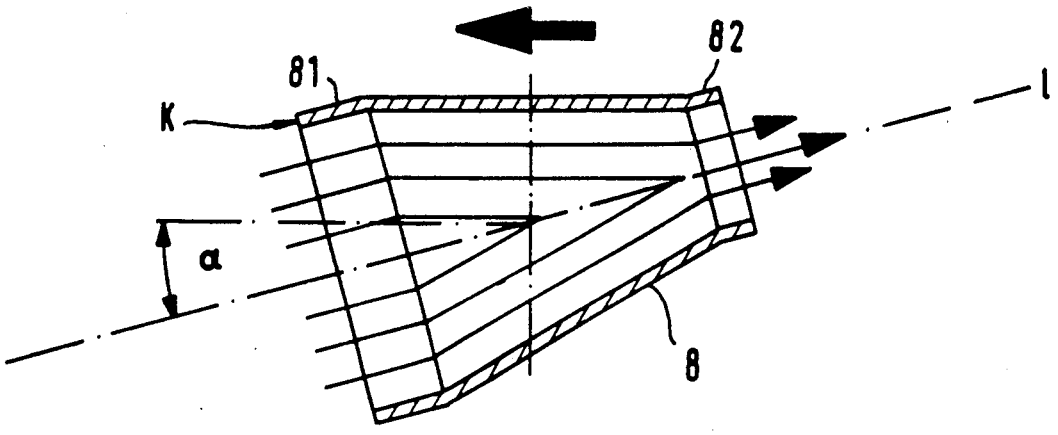
FIG. 3 shows a longitudinal section through a stirring element in the medium to be stirred, with small starting torque and laminar flow.

The frustoconical basic body may open out at one or both ends, as shown in FIG. 3, into a cylindrical inlet 81 and/or outlet 82, the transition zones advantageously being concavely dished in each case. A very good thorough mixing is achieved if the ratio of inlet cross section $F_1$ (FIG. 4) to outlet cross section $F_2$, lies between 1.4 and 3, depending on the viscosity of the medium to be stirred, with the higher value to be chosen in the case of lower viscosity. Furthermore, it has proved favourable if the upper rim of the truncated cone is arranged horizontally. The aperture angle $\alpha$ should be between 10° and 20° for most applications. An aperture angle $\alpha$ of 15° has proved to be good.

Figure 4:
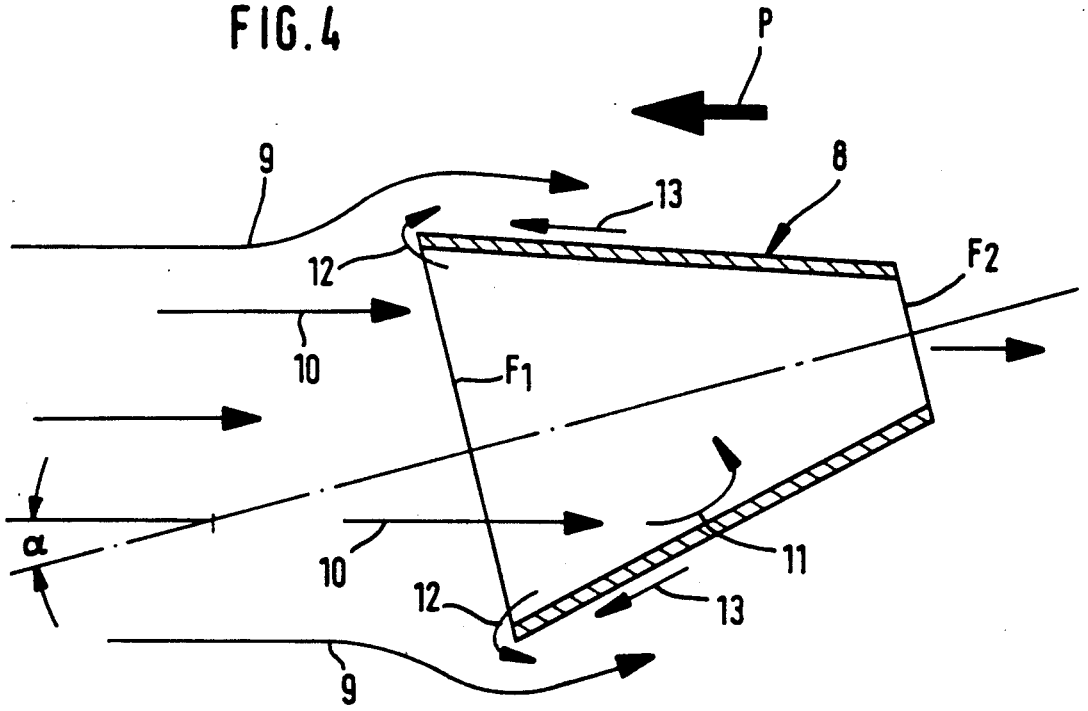
FIG. 4 shows a longitudinal section through a stirring element in the medium to be stirred, in normal operation.

FIG. 3 then shows a laminar flow path of the mixed substance, as occurs in the starting phase. As soon as a minimum velocity has been exceeded, which should be at about 1.3 m/s for most substances, a flow profile like that shown in FIG. 4 is produced.

FIG. 4 once again shows a single stirring element 8 during rotation in the tank, to illustrate the flow conditions occurring. Since the stirring element 8, which is inclined at the angle $\alpha$ of, for example, 12° from the horizontal, moves in the direction of arrow P, a part of the liquid in the path of movement is deflected upwards and outwards and flows around the stirring element 8, that is approximately along the arrows 9. A further part of the liquid enters inside the stirring element 8 in the direction of arrows 10. However, since the liquid flow in the lower stirring element section impinges on its wall and is then deflected upwards in the direction of arrow 11, there is produced in the inlet region of the stirring element a partial flow, which flows around the inlet edge of the stirring element 8 from inside to outside in the direction of arrows 12 and thus continuously prevents that the medium to be stirred impinges on the edge K (FIG. 3) and suffers damage.

It is to be assumed in this case that the partial flow 12 continuously leaving the stirring element 8 meets at the stirring element outer edge the likewise demonstrably occurring counterflow 13, it also being possible for the latter to contribute to the development of the protective material cushion at the mixing element edge K, which normally represents the critical point for products sensitive to impact.

In the case of the known stirring process, on the other hand, the stirred substance strikes the stirring blades, so that a whipping, beating effect is exerted on the stirred substance next to the stirring blades. As a consequence, it is subjected to high mechanical stress, and thus inevitably also to high thermal stress. Such a stressing may cause various materials to undergo a no longer tolerable change or damage.

In the case of the process according to the invention, the solids contained in the stirred substance are kept away from the actual stirring element, so that there is no direct contact between the solids and the stirring element. This is demonstrated in particular in the stirring of an extremely sensitive stirred substance, for example in the stirring of liquid crystals and in biochemistry.

An essential aspect of the apparatus according to the invention is the fact that the stirring elements 4a, 4b, 4c and 4d are fixed not via a solid disk, but by means of spoke-like arms L on the shaft 2. Only in this way is it namely possible for there to develop within the tank G a continuous, unbroken flow U (FIG. 1), which rises upward in the vicinity of the tank wall and has the tendency to go down again in the central region of the tank, coaxial to the shaft 2, where it passes through the intermediate spaces 2 between the arms L. When it passes the stirring element zone, this continuous flow is set into turbulence by the rotating stirring elements 4a to 4d, this turbulence imparted on the continuous flow U extending virtually over the entire tank height and contributing to the surprising stirring results from the aspect of gentle material treatment and the shortening of stirring times.

In this context it also becomes apparent why not only a poorer homogenization but also considerably longer stirring times are produced with the use of stirring elements fixed on solid disks: the development of the continuous flow U is prevented by the disks, so that virtually only radial flows occur.

The movement is already more extensive at low velocities than in the case of the conventional stirring methods. The stirred substance is also subjected to stirring at the edges of the stirring vessel, so that a rectangular stirring vessel or a flat tank bottom could be used without any problems, if this be necessary for the intended application.

The dynamic pressure and the resultant counterflow have the effect as it were of shielding the edges of the stirring elements, so that scarcely anything can catch on them. Therefore, fibrous media can also be stirred without any hesitation, as applies for example to treatment plants, without fibers catching on the stirring elements in the shortest time and hindering the stirring operation.

Thanks to the very low circumferential velocity and the extremely short mixing time, there is no appreciable heating of the stirred substance. As a result, the above design is also excellently suited for bioreactors, it being possible to omit the conventional cooling systems, which simplifies the entire apparatus significantly and represents a considerable cost saving.

EXAMPLE

A company owned by Basler Grosschemie used the apparatus according to the invention for the stirring and keeping in suspension of a paint suspension. The requirements specifically demanded of the apparatus were the following in particular:

(1) The mixing mechanism should not take in any air,
(2) Foaming should be prevented by very low speed, and
(3) In spite of the low speed, the solids should be evenly distributed in the tank.

| Test Data: | | |
|---|---|---|
| Tank: dia. 2600 mm | Height 5600 mm | Content: 16000 lt. |
| Medium: | Paint suspension | |

-continued

| Test Data: |
|---|
| Viscosity: 325 cp<br>Density: 1 to 1.2<br>Temperature: 30–35° C. |

| Solution | |
|---|---|
| Stirrer: | With 3 stirring elements, stirring circle dia. 1200 mm |
| Drive: | Worm gear motor 2.1/2.9 kW pole-reversible<br>Speed: 21 and 42 rpm, respectively<br>Stirring shaft: dia. 60/50 × 5300 mm long (without separate supporting bearing) |

An excellent mixing effect without any foaming was already achieved after an extremely short stirring time of 18 seconds, with low power requirement and low procurement and operating costs.

In a further development of the invention, the supporting arms are connected to the rotational shaft 2 via a joint, so that the supporting arms can be easily introduced together with the stirring elements even into tanks with narrow openings. As soon as the rotational shaft is set in motion, the supporting arms together with the stirring elements work themselves into an approximately horizontal working position, due to the centrifugal forces acting on them.

Figure 2:
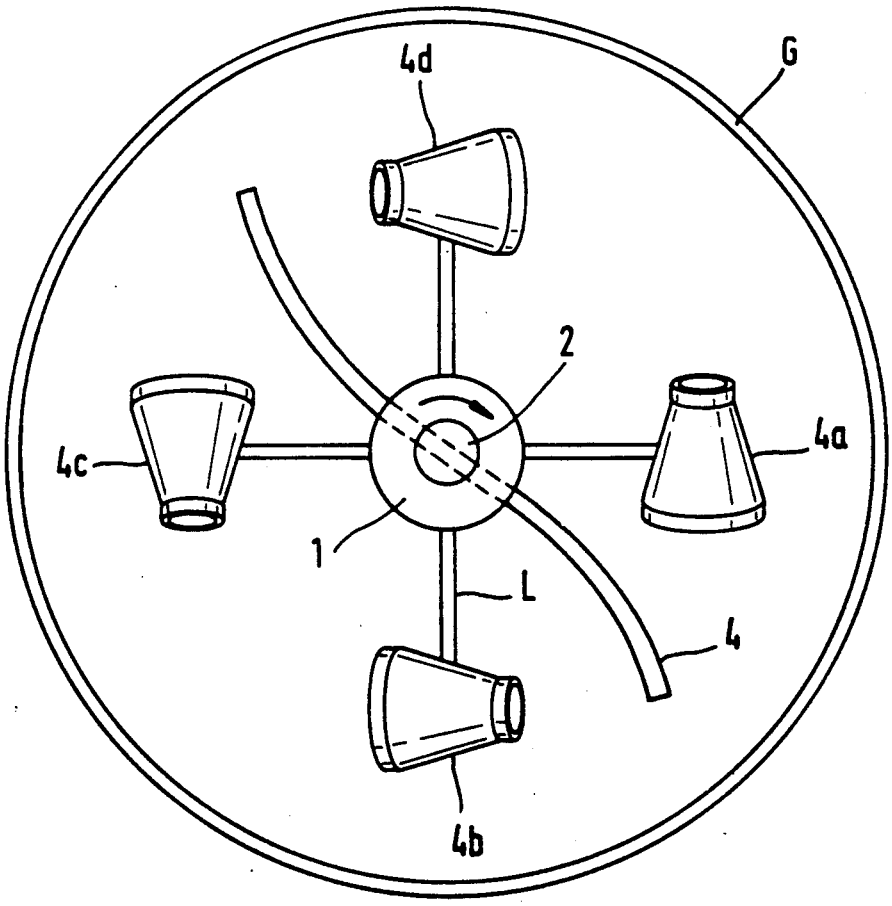
FIG. 2 shows the associated plan view.

A further improvement of the thorough mixing of the product is produced if the stirring elements 4a, 4b, 4c are, according to FIG. 2, provided with an auxiliary element 4. The latter is preferably of a swept S shape, is connected rotationally rigidly to the stirrer and prevents the formation of a dead zone in the center, in particular where large stirring tanks are used.

As FIG. 1 further shows, the stirring apparatus must be arranged as far as possible in the vicinity of the tank bottom. In the ideal case, the distance h of the stirring element axes from the tank bottom should be approximately 3D, D being the diameter at the inlet cross section of the stirring elements. In any event, the stirring elements should be arranged in the lower third of the tank. In the event that a tank/stirrer combination is to be used to stir more than one type of fluid, or if a single stirrer is to be employed in a variety of tanks having different dimensions, the stirring elements and/or shaft should be longitudinally displaceable so that the stirring elements can be positioned at the desired distance from the bottom of the tank. This can be accomplished by a variety of conventional means selectable as a matter of design choice by the ordinary artisan. In positioning the stirring elements in the tank, it is preferably that the distance from the bottom be chosen as a function of the viscosity of the medium to be stirred, the smallest bottom clearance corresponding to the greatest viscosity.

As tests have shown, the circumferential velocity of the stirring elements should, with a view to optimum stirring results, lie between 0.64 and 3.0 m/sec. At higher circumferential velocities, it has been found that the medium to be stirred is no longer displaced, as desired, gently by the stirring elements but that the flows break off and the flow path described is disturbed.

By use of the stirring elements according to the invention and the flow path and the shortening of the stirring time thereby attained, a surprising reduction in the energy requirement could also be achieved. In comparative tests with the known stirring elements, fixed on circular disks, the energy consumption was reduced to virtually one tenth.

I claim:

1. An apparatus for gently stirring and mixing fluids, especially highly viscous fluids, contained within a vessel by rotary motion, comprising:

(a) a rotatable vertical shaft;

(b) at least two hollow, substantially frustoconical stirrer elements, each of said stirrer elements having a first open end of a first cross section and a second open end of a second cross section which is less than said first cross section, the ratio of said first cross section to said second cross section being in the range of 1.4 to 3.0;

(c) a cylindrical inlet ring located at said first open end of each of said stirrer elements;

(d) rotating means for rotating said shaft such that said stirrer elements are rotated at a circumferential velocity in a range from 0.64 to 3.0 meters/second and such that said first open ends lead said second open ends as said stirrer elements are rotated about said shaft in a circular path; and (e) a plurality of spoke-like arms corresponding in number to the number of said stirrer elements, said arms being radially spaced around said shaft and projecting substantially perpendicularly therefrom, one end of each of said arms being affixed to said shaft and an opposite end of each of said arms being affixed to a corresponding one of said stirrer elements such that a longitudinal axis of each of said stirrer elements is substantially tangent to said circular path and is at an angle of from 10 degrees to 20 degrees with respect to a horizontal plane containing said circular path, said first open ends of said stirrer elements facing generally downward relative to said horizontal plane and said second open ends of said stirrer elements facing generally upward relative to said horizontal plane.

2. An apparatus as claimed in claim 1, wherein each of said stirrer elements includes a cylindrical outlet ring located at said second open end thereof.

3. An apparatus as claimed in claim 1, wherein the vessel is cylindrical and the distance between said longitudinal axes of said stirrer elements and an axis of rotation of said shaft is in a range of 1/6 to ⅓ the diameter of the vessel.

4. An apparatus as claimed in claim 3, wherein said stirrer elements are disposed in the bottom ⅓ of the vessel.

5. An apparatus as claimed in claim 1, wherein said longitudinal axes of said stirrer elements are at an angle of from 14 degrees to 16 degrees with respect to said horizontal plane.

6. An apparatus as claimed in claim 1, wherein said longitudinal axes of said stirrer elements are at an angle of 15 degrees with respect to said horizontal plane.

7. An apparatus as claimed in claim 1, wherein said ratio of said first cross section to said second cross section is 1.5.

8. An apparatus as claimed in claim 1, wherein said ratio of said first cross section to said second cross section is 3.0.

9. An apparatus as claimed in claim 1, further comprising an S-shaped stirring member affixed to said shaft below said arms, said S-shaped stirring member extending an equal distance in opposite directions from said shaft substantially parallel to said arms.

10. A method for gently stirring and mixing fluids, especially viscous fluids, by rotary motion utilizing an apparatus which includes a rotatable vertical shaft; at least two hollow, substantially frustoconical stirrer elements, each of said stirrer elements having a first open end of a first cross section, a second open end of a second cross section which is less than said first cross section, and a cylindrical inlet ring located at said first open end, the ratio of said first cross section to said second cross section being in a range of 1.4 to 3.0; rotating means for rotating said shaft such that said stirrer elements are rotated at a circumferential velocity in a range between 0.64 and 3.0 meters/second and such that said first open ends lead said second open ends as said stirrer elements are rotated about said shaft in a circular path; and a plurality of spoke-like arms corresponding in number to the number of said stirrer elements, said arms being radially spaced around said shaft and projecting substantially perpendicularly therefrom, one end of each of said arms being affixed to said shaft and an opposite end of each of said arms being affixed to a corresponding one of said stirrer elements such that a longitudinal axis of each of said stirrer arms is substantially tangent to said circular path and is at an angle of from 10 degrees to 20 degrees with respect to a horizontal plane containing said circular path, said first open ends of said stirrer elements facing generally downward relative to said horizontal plane and said second open ends of said stirrer elements facing generally upward relative to said horizontal plane, the method comprising the steps of placing and rotatably supporting said apparatus within a vessel which contains a fluid to be stirred and rotating said shaft of said apparatus such that said stirrer elements are rotated at a circumferential velocity in a range between 0.64 and 3.0 meters/second.

11. A method as claimed in claim 10, wherein said step of rotating induces a flow of through-flowing fluid through said stirrer elements, said through-flowing fluid being displaced upwardly in said vessel, thereby resulting in a continuous transfer flow of fluid from a lower portion of said vessel to an upper portion thereof, said transfer flow passing between and being substantially uninterrupted by said arms.

12. A method as claimed in claim 11, wherein said step of rotating also induces a backflow of fluid within each of said stirrer elements due to the impingement of said through-flowing fluid upon an inner wall of each of said stirrer elements, said backflow running in the same direction as the direction of rotation of said stirrer elements and exiting said stirrer elements through said first open ends thereof.

13. A method as claimed in claim 10, wherein said vessel is cylindrical and the distance between said longitudinal axes of said stirrer elements and an axis of rotation of said shaft is in a range of 1/6 to ⅓ the diameter of said vessel, said stirrer elements being disposed in the bottom ⅓ of said vessel and said longitudinal axes of said stirrer elements being arranged at an angle of from 14 degrees to 16 degrees with respect to said horizontal plane.

14. A method as claimed in claim 10, wherein said fluid has a high viscosity, such as that of a paste, and wherein said ratio of said first cross section to said second cross section is 1.5.

15. A method as claimed in claim 10, wherein said fluid has a low viscosity, such as that of an aqueous solution, and wherein said ratio of said first cross section to said second cross section is 3.0.

16. A method as claimed in claim 10, further comprising the step of adjusting the depth of said stirrer elements within said vessel such that said stirrer elements are lowered for more viscous fluids and are raised for less viscous fluids.

17. A method as claimed in claim 10, further comprising the steps of affixing an S-shaped stirring member to said shaft below said arms and rotating said S-shaped member conjointly with said stirrer elements to thereby prevent the formation of a dead zone during the performance of a stirring and mixing operation by said apparatus.

18. A method as claimed in claim 10, wherein said fluid is a ceramic paste containing air bubbles, said method further comprising the steps of:

(a) rotating said stirrer elements until air bubbles collect around and in said stirred elements;
(b) momentarily decelerating said stirrer elements to thereby permit said collected air bubbles to rise to the surface of said ceramic paste; and
(c) repeating steps (a) and (b) until deaeration and stirring is complete.

19. A method for gently stirring and mixing fluids, especially viscous fluids, by rotary motion utilizing an apparatus which includes a rotatable vertical shaft; at least two hollow, substantially frustoconical stirrer elements, each of said stirrer elements having a first open end of a first cross section and a second open end of a second cross section which is less than said first cross section, the ratio of said first cross section to said second cross section being in a range of 1.4 to 3.0; rotating means for rotating said shaft such that said stirrer elements are rotated at a circumferential velocity in a range between 0.64 and 3.0 meters/second and such that said first open ends lead said second open ends as said stirrer elements are rotated about said shaft in a circular path; and a plurality of spoke-like arms corresponding in number to the number of said stirrer elements, said arms being radially spaced around said shaft and projecting substantially perpendicularly therefrom, on end of each of said arms being affixed to said shaft and an opposite end of each of said arms being affixed to a corresponding one of said stirrer elements such that a longitudinal axis of each of said stirrer arms is substantially tangent to said circular path and is at an angle of from 10 degrees to 20 degrees with respect to a horizontal plane containing said circular path, said first open ends of said stirrer elements facing generally downward relative to said horizontal plane and said second open ends of said stirrer elements facing generally upward relative to said horizontal plane, the method comprising the steps of:

(a) placing and rotatably supporting said apparatus within a vessel which contains a fluid to be stirred;
(b) rotating said shaft of said apparatus such that said stirrer elements are rotated at a circumferential velocity in a range between 0.64 and 3.0 meters/-second, said step of rotating inducing a flow of through-flowing fluid through said stirrer elements, said through-flowing fluid being displaced upwardly in said vessel, thereby resulting in a continuous transfer flow of fluid from a lower portion of said vessel to an upper portion thereof, said transfer flow passing between and being substantially uninterrupted by said arms, said step of rotating further inducing a backflow of fluid within each of said stirrer elements due to the impingement of said through-flowing fluid upon an inner wall of each of said stirrer elements, said backflow running in the same direction as the direction of rotation of said stirrer elements, and exiting said stirrer elements through said first open ends.

20. A method as claimed in claim 19, wherein said backflow continually courses past a peripheral edge of said first open end of each of said stirrer elements, thereby insulating said peripheral edge from contact with other regions of said fluid.

21. A method as claimed in claim 20, wherein said step of rotating also induces an outer flow of fluid parallel and proximate to an outer wall of each of said stirrer elements, said outer flow running in the same direction as the direction of rotation of said stirrer elements and converging with said backflow proximate to said first open end of an corresponding one of said stirrer elements.

22. A method for gently stirring and mixing fluids, especially viscous fluids, by rotary motion utilizing an apparatus which includes a rotatable vertical shaft; at least two hollow, substantially frustoconical stirrer elements, each of said stirrer elements having a first open end of a first cross section and a second open end of a second cross section which is less than said first cross section, the ratio of said first cross section to said second cross section being in a range of 1.4 to 3.0; rotating means for rotating said shaft such that said stirrer elements are rotated at a circumferential velocity in a range between 0.64 and 3.0 meters/second and such that said first open ends lead said second open ends as said stirrer elements are rotated about said shaft in a circular path; and a plurality of spoke-like arms corresponding in number to the number of said stirrer elements, said arms being radially spaced around said shaft and projecting substantially perpendicularly therefrom, one end of each of said arms being affixed to said shaft and an opposite end of each of said arms being affixed to a corresponding one of said stirrer elements such that a longitudinal axis of each of said stirrer arms is substantially tangent to said circular path and is at an angle of from 10 degrees to 20 degrees with respect to a horizontal plane containing said circular path, said first open ends of said stirrer elements facing generally downward relative to said horizontal plane and said second open ends of said stirrer elements facing generally upward relative to said horizontal plane, the method comprising the steps of:

(a) placing and rotatably supporting said apparatus within a vessel which contains a fluid to e stirred;
(b) rotating said shaft of said apparatus such that said stirrer elements are rotated at a circumferential velocity in a range between 0.64 and 3.0 meters/-second; and
(c) adjusting the depth of said stirrer elements within said vessel such that said stirrer elements are lowered for more viscous fluids and raised for less viscous fluids.

23. A method for gently stirring and mixing ceramic paste by rotary motion utilizing an apparatus which includes a rotatable vertical shaft; at least two hollow, substantially frustoconical stirrer elements, each of said stirrer elements having a first open end of a first cross section and a second open end of a second cross section which is less than said first cross section, the ratio of said first cross section to said second cross section being in a range of 1.4 to 3.0; rotating means for rotating said shaft such that said stirrer elements are rotated at a circumferential velocity in a range between 0.64 and 3.0 meters/second and such that said first open ends lead said second open ends as said stirrer elements are rotated about said shaft in a circular path; and a plurality of spoke-like arms corresponding in number to the number of said stirrer elements, said arms being radially spaced around said shaft and projecting substantially perpendicularly therefrom, one end of each of said arms being affixed to said shaft and an opposite end of each of said arms being affixed to a corresponding one of said stirrer elements such that a longitudinal axis of each of said stirrer arms is substantially tangent to said circular path and is at an angle of from 10 degrees to 20 degrees with respect to a horizontal plane containing said circular path, said first open ends of said stirrer elements facing generally downward relative to said horizontal plane and said second open ends of said stirrer elements facing generally upward relative to said horizontal plane, the method comprising the steps of:

(a) placing and rotatably supporting said apparatus within a vessel which contains a ceramic paste to be stirred;

(b) rotating said shaft of said apparatus such that said stirrer elements are rotated at a circumferential velocity in a range between 0.64 and 3.0 meters/-second until air bubbles collect around and in said stirrer elements;

(c) momearily decelerating said stirrer elements to thereby permit said collected air bubbles to rise to the surface of said ceramic paste; and (d) repeating steps b and c until deaeration and stirring is complete.

* * * * *